US005552662A

United States Patent [19]

Makita et al.

[11] Patent Number: 5,552,662

[45] Date of Patent: Sep. 3, 1996

[54] LIGHT WEIGHT SHADOW MASK AND METHOD OF MANUFACTURING

[75] Inventors: Akira Makita; Yutaka Matsumoto; Takahito Aoki, all of Tokyo, Japan

[73] Assignee: Dai Nippon Printing Co., Ltd., Japan

[21] Appl. No.: 312,867

[22] Filed: Sep. 27, 1994

[30] Foreign Application Priority Data

Sep. 28, 1993 [JP] Japan ..... 5-263119

[51] Int. Cl.[6] ..... H01J 29/07; H01J 9/00

[52] U.S. Cl. ..... 313/403; 445/47; 430/5

[58] Field of Search ..... 445/47; 313/402, 313/403; 430/5, 323

[56] References Cited

U.S. PATENT DOCUMENTS 4,210,843 7/1980 Avadani ..... 313/402

4,846,747 7/1989 Higashinakagawa et al. ..... 313/402

FOREIGN PATENT DOCUMENTS 0251821 1/1988 European Pat. Off. ..... H01J 9/14

*Primary Examiner*—Michael Horabik

*Assistant Examiner*—Michael Day

*Attorney, Agent, or Firm*—Parkhurst, Wendel & Burr

[57] ABSTRACT

An aperture grill for a cathode ray tube is formed with parallel slits by etching a cold-rolled low-carbon steel plate from the opposite sides thereof. Before carrying out the etching, the steel plate is subjected to an annealing step whereby the residual stress is reduced to 7.0 Kg/mm$^2$ or less. The steel plate is also subjected to a tensile force for imparting a tension in the direction of the rolling of a hoop steel from which the steel plate is produced. Furthermore, the steel plate is so oriented that the direction of tapes of the aperture grill to be produced will coincide with the rolling direction. The above process makes it possible to prevent occurrence of "streaks" and improves the quality of images generated on the cathode ray tube.

2 Claims, 3 Drawing Sheets

LIGHT WEIGHT SHADOW MASK AND METHOD OF MANUFACTURING

BACKGROUND OF THE INVENTION

The present invention relates to a shadow mask used in a color cathode ray tube and more particularly to an aperture grill having vertical slits, and to a method of producing an aperture grill of the above type having a thickness of 100 μm or less.

As a material for aperture grills, cold-rolled low-carbon rimmed steel plate, cold-rolled low-carbon aluminum killed steel plate or low-carbon Fe—Ni invar (36% Ni—Fe alloy) have heretofore been used because these materials are suitable from the viewpoint of being able to be fabricated on an aperture grill, etched and formed into a shape adapted for being built into a cathode ray tube. There are many kinds of shadow masks which are different in the shape of the apertures or openings, in the way of building into the cathode ray tube and in the way of processing during the fabrication. One of the above mentioned materials has been used depending upon the kind of shadow mask. In general, a low-carbon Fe—Ni invar of low coefficient of thermal expansion or a cold-rolled low-carbon aluminum killed steel plate has been used for shadow masks of the slot type and circular hole type. Particularly, the low-carbon Fe—Ni invar of low coefficient of thermal expansion has recently been used with a view to avoiding color deviation that occurs in the cathode ray tube due to thermal expansion when the tube is put into operation.

In the case of shadow masks of the slot type or circular hole type, there is a problem of curling that occurs during the etching process due to a difference in relieving of residual stresses in the regions of the front and rear side openings of the slots or holes because of the difference in the dimension or diameter of the front and rear side openings, whereas in the case of aperture grills such a problem of curling does not occur. Aperture grills are fit into a cathode ray tube in a different way from the other types of shadow masks, and moreover can be formed without plastic deformation in a press. For the above reason, the cold-rolled low-carbon rimmed steel plate has been principally used heretofore for aperture grills.

Aperture grills have heretofore been produced, using a low-carbon steel plate such as a cold-rolled low-carbon rimmed steel plate of a thickness of more than 100 μm. A method of producing an aperture grill was to carry out concurrent etching of a low-carbon steel plate on the opposite surfaces thereof to produce through slits. This method is called a one-step etching method.

Another method of producing an aperture grill is as follows. That is, a low-carbon steel plate is applied with photosensitive resin layers or resist layers on the opposite front and rear surfaces thereof, and then pattern masks are applied to the opposite resin layers. A front pattern mask has one broad slit pattern and a back pattern mask has a narrow slit pattern. Subsequently, the front and rear pattern masks are printed to the front and rear resist layers, respectively, by exposure to light, and then developments on the resist layers of the printed front and rear patterns are made.

A half-etching is carried out on the rear surface of the steel plate through the developed rear resist layer to form a narrow rear recess in the rear surface of the plate; then an etchant-proof resin is filled into the rear recess and over the rear resin layer on the steel plate; and a broad front recess is etched in the front surface of the steel plate through the developed front resist layer to cause the front recess to reach the half-etched rear recess, whereby a through hole is produced in the steel plate. This method is a two-step etching method.

Another method for producing a shadow mask is disclosed in Japanese Patent Application Laid-Open (Kokai) No. 5-12,996 published Jan. 22, 1993, which corresponds to U.S. Pat. No. 5,348,825. In this method, a steel plate is applied with resist layers on the front and rear surfaces thereof, and then a pattern slit mask is applied to only the front surface and printed by exposure to light, while the rear resist layer is maintained as it is and backed up by a backup resin sheet. Etching is carried out on only the front surface of the steel plate through the printed and developed front resist layer to produce a front recess in the steel plate. The front recess reaches the rear resist layer, whereby a through hole is produced in the steel plate when the rear resist layer is removed together with the backup resin sheet. This is a one-side etching method.

The two-step etching method mentioned above, however, takes time and is not efficiently carried out. The one-side etching method referred to above is not sufficient in producing tapered side walls of each slit so as to have a required exact configuration or shape. For those reasons the one-step etching method has generally been used for producing aperture grills.

In the case of the cold-rolled low-carbon rimmed steel plate, residual stress is usually about 10.0 $Kg/mm^2$ or more when it is subjected to an etching process, but the rimmed steel plate can be used as it is without any particular problems where the plate thickness is more than 100 μm. More specifically, problems have not occurred by taking measures such as to make the direction of the tapes of the aperture grill to be produced by etching of a hoop or band steel, perpendicular to the direction of rolling of the band steel, or to make the direction of the tapes coincide with the direction of rolling of the band steel while tensioning the band steel appropriately. The above measures can prevent the generation of "streaks" in the tapes of the aperture grill. The streaks are produced due to relieving of residual stresses as a result of breakthrough of the slits between the front and rear surfaces of the steel plate during the etching step. For the cold-rolled low-carbon aluminum killed steel plate, the residual stress is generally more than 10.0 $Kg/mm^2$ as in the case of the cold-rolled low-carbon rimmed steel plate.

In recent years, CRT display devices such as color televisions are becoming enlarged in size, so that shadow masks used in such devices are required to be of large size as well. Particularly, in aperture grills, the manner of fixing the same is different from the manner of fixing of other types of shadow masks having slots or circular openings. That is, the aperture grill is fixed under tension to a rigid frame. For this reason the frame must necessarily be enlarged in relation to the enlarged aperture grill and is required to resist the tension necessary for the fixing of the aperture grill of the conventional thickness. As a consequence, the weight of the frame is increased remarkably. In order to cope with this increase in the weight of the frame, the weight of the aperture grill must be reduced so that the thickness of the aperture grill will have to be reduced to compensate for the enlargement of the size.

Thus the thickness of the material for producing aperture grills should not exceed 100 μm. The above stated measures have been able to solve the problems mentioned above for the material of a thickness of more than 100 μm. Contrary to the case where the material is more than 100 μm thick, the material or hoop steel of a thickness of 100 μm or less causes the following problem. That is, if the material or hoop steel were subjected to etching in such a state that the direction of the tapes of an aperture grill into which the material is manufactured are perpendicular to the rolling direction of the hoop steel, conveying rolls or shafts of the conveying system for the hoop steel would deform the hoop steel because it is thin. Therefore, the above measure which has been employed for thicker hoop steels is not usable. The heretofore used second measure of making the direction of the tapes coincide with the rolling direction while tensioning the steel was found to be also not usable when the one-step etching method is employed because streaks of the tapes occur due to relieving of residual stress when the slits penetrate the steel plate during the etching process. Under the circumstances, etching methods usable for hoop steel plates of a thickness 100 μm or less, to be manufactured into large-size aperture grills, have been limited to the time-consuming two-step etching method that requires reinforcing means, as well as to the one-side etching method that involves the difficulty in obtaining required exact shape of the tapered side walls of the slits.

As above stated, the one-step etching method has advantageously been used heretofore, but this method is disadvantageous for use in etching of a thin steel plate having a thickness of 100 μm or less because of the generation of streaks due to relieving of the residual stress at the time of penetration of the slits through the steel plate.

The streaks are produced due to non-uniformity of stress distribution in the aperture grill tapes. The non-uniform stress distribution causes twisting of each tape, which appears remarkably when the thickness of the steel plate is below 100 μm. It is known that streaks cause variations in the quantity of light that passes through the aperture grill and consequently cause degradation of the quality of images formed on the cathode ray tube in which the aperture grill is fitted.

SUMMARY OF THE INVENTION

It is an object of the present invention to provide a method of producing an aperture grill, using a one-step etching method, in which occurrence of streaks can be prevented even in the case where the thickness of the steel plate from which the aperture grill is made is 100 μm or less.

It is another object of the present invention to provide an aperture grill in which streaks do not occur.

According to the present invention, there is provided a method of producing an aperture grill for a cathode ray tube, comprising the steps of: preparing a steel plate; applying front and rear photosensitive resist layers to opposite surfaces of the steel plate, respectively; applying front and rear slit pattern masks to the front and rear photosensitive resist layers, respectively; printing the front and rear slit pattern masks on the front and rear resist layers, respectively; developing printed slit patterns in the front and rear resist layers; etching the opposite surfaces of the steel plate through the thus developed front and rear resist layers, respectively, to produce a front recess and a rear recess; causing the front recess and the rear recess to communicate with each other as the step of etching proceeds, thereby to form a slit together with adjacent parallel tapes; and removing the front and rear resist layers from the opposite surfaces of the steel plate; the method being characterized by the steps of: preparing said steel plate in the form of a cold-rolled low-carbon steel plate of a thickness of 100 μm or less, from a hoop steel having a rolling direction; processing the steel plate to have a residual stress of 7.0 Kg/mm$^2$ or less; tensioning the steel plate in said rolling direction; and coinciding the direction of the tapes of the aperture with the rolling direction.

Further, according to the present invention, there is provided an aperture grill for a cathode ray tube, comprising: a cold-rolled low-carbon steel plate of a thickness of 100 μm or less, having slits formed therethrough together with parallel adjacent tapes, said plate having a residual stress of 7.0 Kg/mm$^2$ or less and being made from a hoop having a rolling direction; and said tapes extending in a direction coinciding with the rolling directions.

Further details of the present invention will be understood from the following detailed description with reference to the accompanying drawings.

DESCRIPTION OF THE PREFERRED EMBODIMENT

Figure 1:
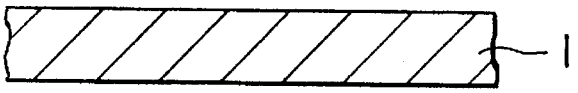
FIG. 1 is a sectional view of a steel plate used in the method of the present invention.
Figure 8A:
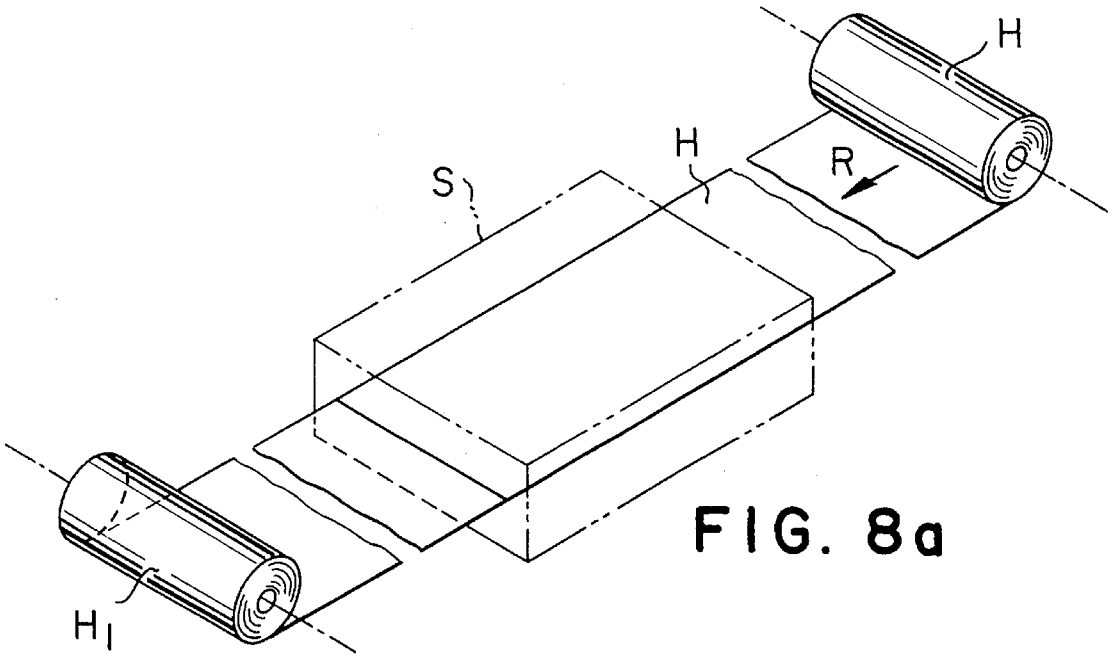
FIGS. 8*a* and 8*b* are diagrammatic perspective views explanatory of the method of the present invention.

Referring to FIG. 1 there is illustrated a plate 1 from which an aperture grill is produced. The plate 1 is made of a cold-rolled low-carbon steel having a thickness of 100 μm or less. Such a steel plate 1 is made from a steel band or hoop H as shown in FIG. 8*a* that has been produced by a rolling mill. As a result of rolling operation in the mill, the hoop H naturally has a rolling direction R and residual stress therein.

The hoop H is subjected to a residual stress removing operation. This residual stress removing operation may be carried out as an annealing operation in an annealing furnace S. As a result of the annealing operation, the residual stress in the hoop H is reduced to a value of 7.0 Kg/mm$^2$ or less. The hoop H that has undergone the residual stress removing operation is taken up in the form of a roll of hoop $H_1$.

Figure 2:
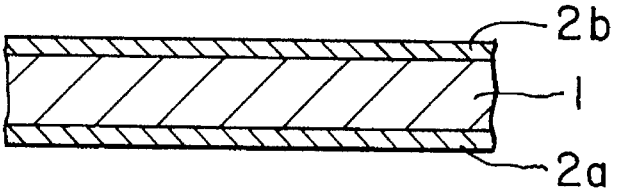
FIG. 2 shows a step of applying photosensitive resin layers.
Figure 7:
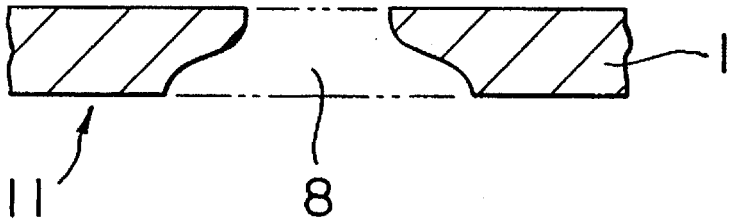
FIG. 7 shows a section of a finally obtained slit of an aperture grill.
Figure 8B:
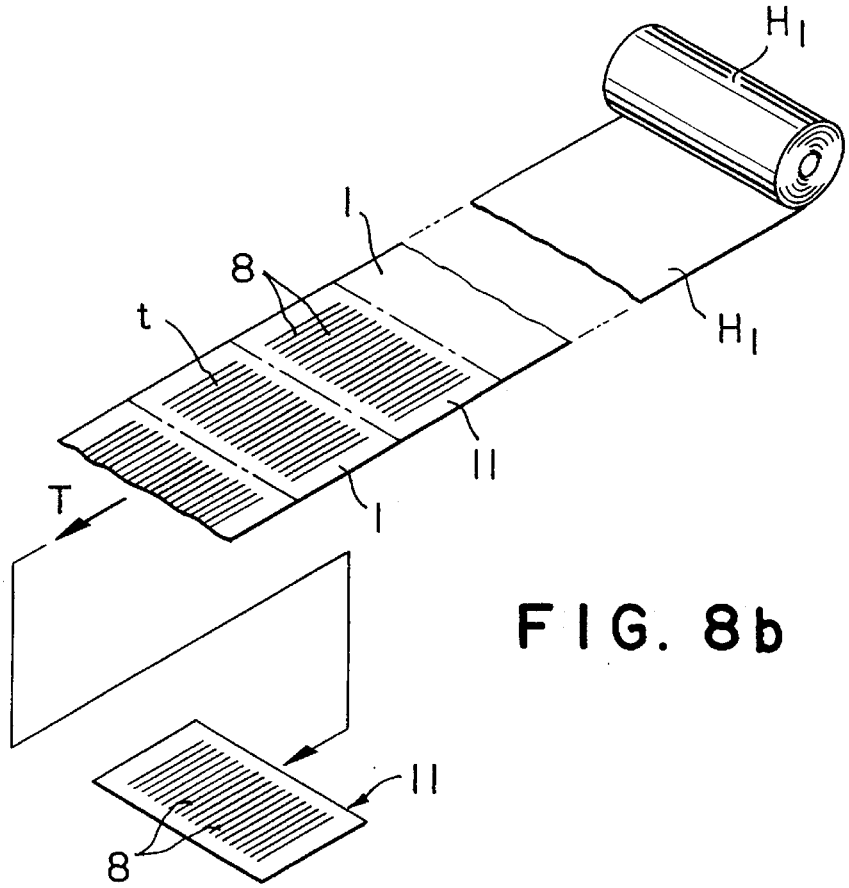

An etching operation for forming slits through the steel plate 1 is carried out as a one-step etching operation. As shown in FIG. 8*b*, the hoop $H_1$ is fed out from the roll; formed with slits 8; and then cut into individual plates 1. FIG. 2 through FIG. 7 show successive steps including the one-step etching operation. As shown in FIG. 2, a photosensitive resin material or resist is applied to the opposite surfaces of the steel plate 1 to form front and rear resist layers 2*a* and 2*b*, which are then dried. In the figures the lower side of the plate 1 is a front side and the upper side is a rear side. On the front side of the front resist layer 2*a* is applied a front pattern mask 4*a*, and on the rear side of the rear resin layer 2*b* is applied a rear pattern mask 4*b*. These masks 4*a* and 4*b* have mutually oppositely disposed light-intercepting slit patterns 5*a* and 5*b*, respectively. In this embodiment, the slit pattern 5a is broader than the slit pattern 5b.

Thereafter, exposure to light of the photosensitive resin layers 2a and 2b is carried out through the masks 4a and 4b, respectively, as indicated by arrows L. As a result of the exposure to light, the slit patterns 5a and 5b are printed on the resist layers 2a and 2b, respectively. In the embodiment, the resin layers are shown as photosetting layers.

Figure 4:
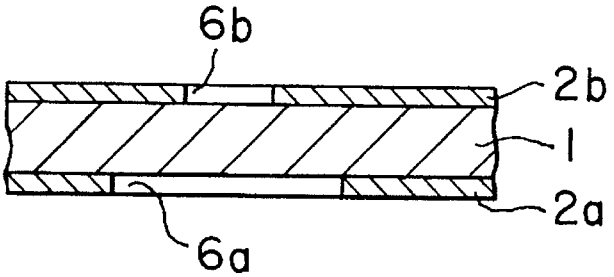
FIG. 4 shows a step of developing the printed slit patterns.

After removal of the masks 4a and 4b and development of the printed slit patterns, the front resist layer 2a is caused to have a broader slit 6a, while the rear resist layer 2b is caused to have a narrower slit 6b, as shown in FIG. 4.

Figure 5:
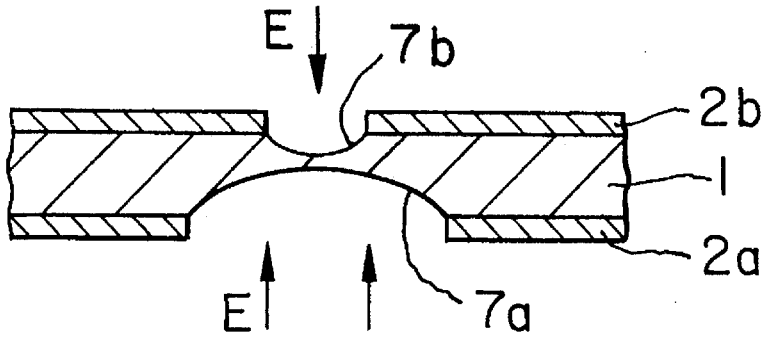
FIG. 5 shows an etching step.

Then, as shown in FIG. 5, the steel plate 1 is subjected to an etching operation through the front and rear resists 2a and 2b as indicated by arrows E on both the front and rear sides. This is a so-called one-step etching method wherein the etching on the front side and the etching on the rear side are carried out concurrently or in one step. Thus a larger front etching recess 7a and a smaller rear etching recess 7b are formed. As the etching proceeds, these two opposite etching recesses 7a and 7b are enlarged and finally reach each other to form a through slit 8 having opposite tapered side walls 10. Thereafter the resists 2a and 2b are removed, whereby, as shown in FIG. 7, an aperture grill 11 having a slit 8 defined between adjoining parallel "tapes" t(FIG. 8b) is produced.

During the steps shown in FIG. 2 through FIG. 7, the steel plate 1 is subjected to a tensile force T (FIG. 8b) in the rolling direction R thereof. The rolling direction is the longitudinal direction of the hoop H from which the steel plate 1 is made. The rolling direction is the direction perpendicular to the sheet of FIGS. 1 through 7, and this rolling direction R coincides with the direction of the tapes t of the aperture grill, according to the present invention.

In aperture grills having slits, requirements therefor are different from those for shadow masks of the other types having slots or circular openings, and it has been said that a low-carbon rimmed steel plate can meet the requirements for aperture grills. In general, a hoop of the low-carbon rimmed steel has a residual stress of 10.0 $Kg/mm^2$ or more so that when a thickness of 100 μm or less is used for the low-carbon rimmed steel, generation of streaks of the tapes cannot be prevented when slits are formed by etching through the thickness of the steel, as discussed hereinbefore.

It has been found that by further reducing the residual stress of the steel plate to a value of 7.0 $Kg/mm^2$ or less in the residual stress relieving step, the generation of streaks can be suppressed. The coincidence of the direction of the tapes with the rolling direction further serves to suppress the generation of the streaks. It will be understood from a consideration of FIG. 8b that the tensile force T is applied to the plate 1 in the longitudinal direction of the slits 8 so that the linearity of the slits and tapes are not adversely affected.

According to the present invention, it is possible to use, as a cold-rolled low-carbon steel, one of cold-rolled low-carbon rimmed steel, a cold-rolled low-carbon aluminum killed steel, and a low-carbon Fe—Ni invar (36% Ni—Fe alloy).

As a result of elimination of the streaks, the uniformity of distribution of the quantity of light that passes through the aperture grill is improved with consequent improvement of the quality of images produced by the cathode ray tube.

EXAMPLE

As a material for an aperture grill, a cold-rolled low-carbon rimmed steel of a thickness of 100 μm was used. Plates made of this rimmed steel were subjected to an annealing in an annealing furnace having an atmosphere of $N_2$ gas at a temperature of 500° C. As a result of the annealing, residual stress in the steel plates was reduced. For purposes of comparison other cold-roll low-carbon rimmed steel plates of a thickness of 100 μm were prepared. These steel plates were not subjected to an annealing so that the steel plates had an initial residual stress remaining therein. Those two kinds of steel plates, that is, the first annealed plates and the second non-annealed plates, were subjected to successive processing steps as shown in FIG. 2 through FIG. 7 under exactly the same conditions.

Figure 3:
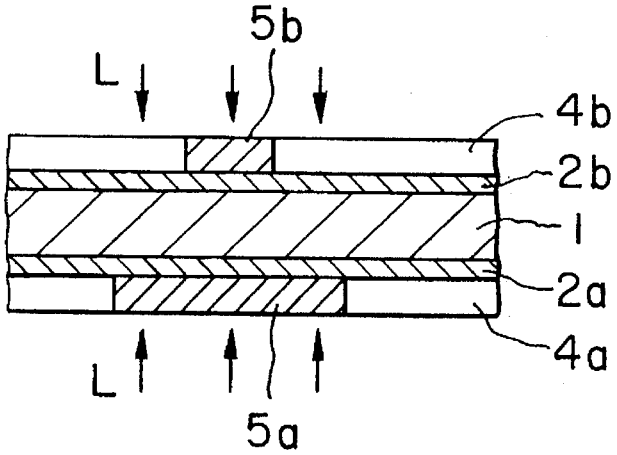
FIG. 3 shows a step of applying slit pattern masks and exposing the photosensitive resin layers through the masks.

The first and second plates (1) were first cleaned by rinsing in the state of FIG. 1. Then, in the step of FIG. 2, a casein resist was applied to the front and lower surfaces of the plates to form front and rear resist layers (2a, 2b), which were then dried. Thereafter, printing was carried out, with slit pattern masks (4a, 4b) applied, by means of mercury arc lamps on the front and rear resist layers, as shown in FIG. 3. Thus latent slit images corresponding to the slit patterns were produced. Upon developing, opposite slits were formed in the front and rear resist layers as exemplified in FIG. 4.

Figure 6:
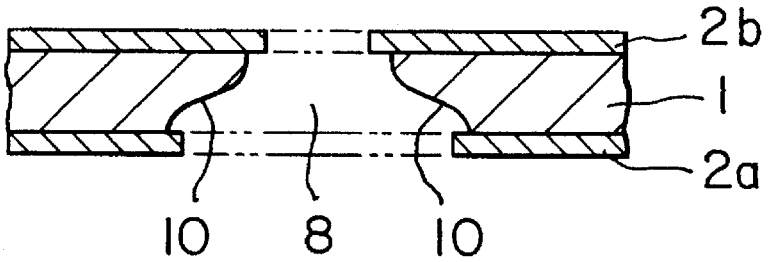
FIG. 6 shows a progress of the etching step.

An etching was carried out on the front and rear surfaces of the two kinds of plates, using a ferric chloride solution in the manner shown in FIGS. 5 and 6. Thus a slit was formed through each of the plates. The resist layers on the opposite surfaces of each plate were removed by using an alkaline solution to obtain an aperture grill as shown in FIG. 7.

The width of each tape of the aperture grill was 520 μm for the two kinds of plates. The temperature of the ferric chloride solution was 60° C., and the specific gravity of the solution was 46 when measured by the Baumé's hydrometer. The ferric chloride solution was sprayed concurrently against the front and rear surfaces of the plates. While the etching was being carried out, the plates were subjected to a tensile force which put the plates under tension in the rolling direction, that is, the longitudinal direction of a hoop from which the plates were prepared. The direction of the tapes of the aperture grill to be prepared was made to coincide with the rolling direction of the plates. The tensile force employed was from 2 to 3 $Kg/mm^2$ which acts to cancel the residual stress in the plates.

After slits were formed, the quantity of light that passes through each produced aperture grill was measured, and variation of the quantity of light was measured among the produced aperture grills. Residual stress after the annealing was also measured for each plate. The residual stress was measured by the X-ray diffraction method. The following table shows the results of the comparison test.

| | RESIDUAL STRESS ($Kg/mm^2$) | VARIATION OF QUANTITY OF LIGHT PASSING APERTURE GRILL |
|---|---|---|
| (THE PRESENT INVENTION) ANNEALED PLATE | (1) 9.0 | 0.19 |
| | (2) 8.0 | 0.19 |
| | (3) 7.0 | 0.15 |
| | (4) 6.0 | 0.14 |
| | (5) 4.4 | 0.14 |
| NON-ANNEALED PLATE | 10.9 | 0.20 |

It will be understood that variation of the quantity of light that passes through the aperture grills using the annealed plates was remarkably smaller than that of the aperture grill using the non-annealed plate, especially in the case where the residual stress is caused to be 7.0 $Kg/mm^2$ or less.

What is claimed is:

1. An aperture grill for a cathode ray tube, comprising a cold-rolled, low-carbon steel plate having a thickness of 100 μm or less, and having slits formed therethrough to define parallel adjacent tapes, said plate having a residual stress of 7.0 $Kg/mm^2$ or less and being made from a hoop having a rolling direction, said tapes extending in a direction coinciding with said rolling direction.

2. An aperture grill for a cathode ray tube, comprising:

a cold-rolled, low-carbon steel plate having a thickness of less than 100 μm, said plate having therethrough slits each defined between adjacent parallel tapes, said plate being made from a hoop having a rolling direction and having a residual stress of 7.0 $Kg/mm^2$ or less; and said tapes extending in a direction coinciding with said rolling direction.

* * * * *